US012419372B2

(12) United States Patent
Konukoglu et al.

(10) Patent No.: US 12,419,372 B2
(45) Date of Patent: Sep. 23, 2025

(54) METHOD AND SYSTEM FOR PRODUCING A COMPRESSION GARMENT AND CUSTOMIZED GARMENT THUS PRODUCED

(71) Applicant: Sanko Tekstil Isletmeleri San. Ve Tic. A.S., Inegol-Bursa (TR)

(72) Inventors: Fatih Konukoglu, Inegol-Bursa (TR); Serkan Mert, Inegol-Bursa (TR); Tuncay Iyidogan, Inegol-Bursa (TR); Agamirze Hamitbeyli, Inegol-Bursa (TR); Erdogan Baris Ozden, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 34 days.

(21) Appl. No.: 18/455,808

(22) Filed: Aug. 25, 2023

(65) Prior Publication Data

US 2024/0065356 A1 Feb. 29, 2024

(30) Foreign Application Priority Data

Aug. 26, 2022 (EP) ..... 22192469

(51) Int. Cl.
*A41D 31/18* (2019.01)
*D02G 3/32* (2006.01)
*D06F 71/00* (2006.01)

(52) U.S. Cl.
CPC ..... *A41D 31/18* (2019.02); *D02G 3/326* (2013.01); *D06F 71/00* (2013.01); *A41D 2600/10* (2013.01)

(58) Field of Classification Search
CPC ..... A41H 5/00; A41H 43/00; D06F 71/00; D02G 3/326; A41D 31/18
See application file for complete search history.

(56) References Cited

U.S. PATENT DOCUMENTS

| | | | | |
|---|---|---|---|---|
| 4,645,629 | A * | 2/1987 | Stern | B29C 66/43 264/479 |
| 6,174,486 | B1 * | 1/2001 | Jin-Ya | D06C 5/005 264/327 |
| 9,554,096 | B1 | 1/2017 | Eakins | |
| 2006/0097016 | A1 * | 5/2006 | Nan | A41H 5/02 223/67 |
| 2009/0019615 | A1 * | 1/2009 | Young | A41B 13/10 2/49.1 |
| 2012/0116282 | A1 * | 5/2012 | Cros | D04B 1/16 602/76 |
| 2013/0260129 | A1 | 10/2013 | Agzikara et al. | |

(Continued)

OTHER PUBLICATIONS

European Search Report and written opinion issued by the EPO on Jan. 27, 2023 for EP priority application No. 22192469.9.

*Primary Examiner* — Uyen T Nguyen

(57) ABSTRACT

A method for producing a compression garment for a user from an elastic fabric comprises the step of providing a base garment, fitting the garment on a supporting mannequin that has a plurality of independent heating means to independently heat different portions of the garment, measuring the compression applied to the mannequin portions by the garment and heating selected portions of the garment until the compression of the garment on the mannequin has reached a desired value.

21 Claims, 4 Drawing Sheets

(56) References Cited

U.S. PATENT DOCUMENTS

| | | | | |
|---|---|---|---|---|
| 2014/0165265 | A1* | 6/2014 | Tulin | A41D 1/06 2/234 |
| 2017/0266052 | A1* | 9/2017 | Levine | A61F 13/00051 |
| 2018/0049482 | A1* | 2/2018 | Erkus | D03D 15/217 |
| 2020/0102675 | A1* | 4/2020 | Nygård | D04B 1/04 |

* cited by examiner

METHOD AND SYSTEM FOR PRODUCING A COMPRESSION GARMENT AND CUSTOMIZED GARMENT THUS PRODUCED

TECHNICAL FIELD

The present invention relates to a method and a system for producing a compression garment and to the garments thus produced. In particular, the present invention relates to form-fitting stretchable compression garments and to methods for forming the same.

BACKGROUND

In the textile industry it is standard practice to manufacture garments in several sizes in order to satisfy the needs of various wearers who wear different garments in their everyday activities and also in sport, fitness or training activities. Manufacturing of garments in several sizes is a costly activity.

Wearers nowadays are more and more interested in form-fitting garments which can fit their body shape and provide a pleasant wearing feeling according to their needs and according to the activity they are performing.

Today garments formed of stretchable fabrics have become very popular in the form-fitting garment industry. Stretchable garments typically comprise of elastomeric fibers that have a high elongation and an elastic behavior so that, after elongation, they return to substantially their initial dimensions. Additionally, compression sport garments are also of great interest because of their ability to help the wearer in practicing sport.

As a result, a further problem with this type of garments is that the garments should always correctly fit to the body of the wearers. Usually, a garment that correctly fits to the body of a wearer provides a target (non-null) compression to the wearer body. In this regards, it may occur that a portion of the garment correctly fits to the wearer body (i.e. it applies a pre-defined target compression to the body), while a different portion of the same garment does not correctly fit to the wearer body, i.e. it applies a compression to the wearer body different from a pre-defined target compression, too little or too much compression, possibly no compression at all.

It is thus an object of the present invention to solve the above mentioned problem.

It is in particular an object of the present invention to provide a method for providing a compression garment in different sizes that is easier and more cost-effective than the prior art, and a relevant system for carrying out such a method.

It is a further object of the present invention to provide a method, and a relevant system, for easily producing a compression garment that provides target compressions at different locations of the body of the final wearer.

These and other problems are solved by the present invention according to one or more of the appended claims.

In particular, it is an object of the present invention a method and a relevant system for producing a compression garment according to the independent claims, while preferred aspects are recited in the dependent claims. A garment as obtainable with the above discussed method is also an object of the invention.

An aspect of the invention relates to method for producing a compression garment for a user from an elastic fabric, the method comprises the step of providing a base garment, fitting the garment on a supporting mannequin that has a plurality portions including a plurality of independent pressure sensors and of independent heating means to independently heat different portions of the garment, measuring the compression applied to the mannequin portions by the garment and heating selected portions of the mannequin to heat corresponding portions of the garment until the compression of the garment on the mannequin has reached a desired value.

In particular, an aspect of the present invention relates to a method for producing a compression garment for a user, the garment having a plurality of circumferential lengths at different axial size locations to apply compression to corresponding locations of the user when the garment is worn, the method comprising the steps of: A. Providing a plurality of desired compressions to be applied by the garment on the user at said plurality of different axial size locations; B. Producing a base garment with a woven fabric comprising elastic fibers, and having elasticity, i.e. stretch of at least 15%; C. Wearing the base garment on a supporting element, the supporting element being provided with a plurality of heaters located at different axial locations of said supporting element and operable independently one from the other; D. Determining the actual compressions exerted by the base garment on the supporting element at different axial locations of said supporting element, corresponding to locations of the user; E. Determining target compressions to be exerted by the base garment on the supporting element at the different axial size locations of the garment so that the compression garment worn by the user exerts a desired compression at the different axial size locations; F. Operating the heaters of at least some of said axial locations of the supporting element to heat the base garment at said different axial size locations of the garment, so that the actual compressions exerted by the base garment are lowered to reach the target compressions; G. Cooling the base garment.

In step B, the garment is produced so that, at step C, a non-null compression is applied by then garment to the supporting element at different axial locations in the step E.

As discussed, in step B, the fabric of base garment has elasticity, i.e. a stretch, of at least 15%. The base garment is made of a woven fabric that when tested with ASTM D3107 (load of 3.0 lb and testing time of 30 minutes), at least in one of weft or warp direction, has an elongation, or stretch, of at least 15%. Elasticity, i.e. stretchability, is preferably at least in the weft direction of the fabric in the garment, so as to provide the required compression on the user.

The supporting element used to measure the compression and onto which the garment is fitted, is preferably in the form of a mannequin suitable for the type of compression garment, e.g. a pair of trousers, to be treated according to the invention process; the supporting element or mannequin is dimensioned and shaped according to a profile of a typical user/wearer. It is noted that the final compression garment can be produced according to pre-defined standard wearer size profile (as e.g. known from size charts, data banks, etc) or according to the measures of a modified profile of the user.

Size charts for compression garments are part of the common general knowledge in the field and are commercially available e.g. from the firms Human Solutions and Alvanon. iSize is a portal and body dimensions data base developed by Human Solutions offering access to body dimensions and sizes tables for several Countries. Similarly, Avalon provides size tables, i.e. size charts, that identify the measures of the body of wearers for different sizes gender and countries. E.g. typically, a size chart would provide the measure of circumferential lengths measured at at least seven different axial locations along a leg of a wearer (i.e. the user).

Typically, the mannequin acting as supporting element is made to reflect a profile of a user and is provided with a plurality of pressure (compression) sensors on a plurality of independent portions of the mannequin; this arrangement makes it possible to measure the compression forces at the selected axial locations. Advantageously the shape and dimensions, particularly the circumferential length, of said selected locations of the supporting mannequin are obtained from the above mentioned chart sizes.

Thanks to the present invention, it is possible to manufacture base garments of the same size that can provide, after being treated with the above discussed method, many different final sizes and/or different fits (such as "skin fit", "slim fit", "carrot fit"); as a result, initial production of the garments is easier and cost effective, allowing in addition a high customizability of the final compression garment. Also, thanks to the present invention, it is possible to produce compression garments that provide a desired compression to areas of the wearer's body. This can be done for wearers having different body sizes, i.e. different user profiles, starting from base garments having the same dimensions and elastic (stretch) properties and making use of a same supporting element (supporting mannequin). In fact, thanks to the present invention, the elastic properties of the fabric of the base garment can be modified in order to have a compression garment that provides a desired compression profile (and wearing feeling) to the wearers.

According to a possible aspect, the actual compressions exerted by the base garment on the supporting element, i.e. the mannequin, at different axial locations of the supporting element are measured via sensors of the supporting element.

According to a possible aspect, the sensor measures the actual compression at least during the step of heating the base garment at the different axial supporting element locations. The actual compression exerted by the base garment decreases, under the action of the heating process, until it reaches the target compression. Typically, for a given axial location, the greater is the difference between the actual compression exerted by the base garment, as measured by the relevant sensor(s), and the target compression, the longer will be heating of the base garment.

According to a possible aspect, the temperature of the heaters used to heat the base garment at the different axial supporting element locations may reach a temperature greater than 100° C., preferably in the range between 100° C. and 130° C. This heating treatment results in the change of the properties of the elastic fibers in the yarns and thus in the change in the elastic properties of the base garment, providing a sort of heat setting to the fibers of the base garment.

According to a possible aspect, the activation time of the different heaters is calculated as a function of the difference between the actual compression and target compressions measured at the relevant axial supporting element locations.

According to a possible aspect, the operation of the heaters is started so that the heating treatment is ended substantially at the same time. Thanks to this, it is possible to start the cooling of the garment at the heated portions at different axial locations of the supporting element at the same time.

According to a possible aspect, the cooling of the base garment is performed via at least one of: circulation of a coolant in the supporting element; blowing of a cooling gas, such as air, against the base garment; a Peltier device.

According to a possible aspect, the cooling of the base garment provides a loss of temperature of the supporting element of at least 100° C. degrees at the axial supporting element location. Preferably the above discussed loss of temperature occurs in less than 30 seconds.

This quick cooling step allows to better fix the change in the properties (in particular elastic properties) of the garment, in order to correctly fit to the final wearer.

According to a possible aspect, at least part of the cooling of the base garment is performed with the base garment still worn on the supporting element. Preferably the whole cooling step of the base garment is performed with the base garment still worn on the supporting element.

Another aspect of the invention refers to a system to perform at least step C to G of the method for producing the compression garment. The system comprises a supporting element, generally in the form of a mannequin, provided with a plurality of separate portions at different axial locations of the supporting element. The separate portions of the mannequin are each provided with pressure sensors configured to detect the compression force generated by the garment onto the said portions. The said separate portions are also provided with a plurality of independently operable heaters configured to independently heat a garment worn on the supporting element at corresponding axial locations of the garment.

In particular, the axial size locations of the garment and the axial supporting element/mannequin locations of the supporting element are configured in order to match one with the other, i.e. the distance between the different axial size locations in the garment is the same, or substantially the same, distance between the different axial locations supporting element.

The system further comprises a cooling system configured to cool a garment worn on the supporting element and sensors configured to measure a compression at different supporting element portions applied by a base garment worn on the supporting element.

The supporting mannequin is usually provided with a base support, typically comprising a plate, allowing resting of the supporting element on a flat surface.

Preferred sensors are load cells configured to measure the compression exerted by the base garment on the supporting element at different axial locations, typically independently one from the other.

More in general, during use, the separate portions of the supporting element are compressed by the garment so that such a compression can be measured by the sensors.

Sensors, in particular load cells, can be mounted on a bearing rod or blade placed within the supporting element. A sensor rod can be placed between each of the supporting element portions and each of the sensors, allowing mounting of the portions themselves. The compression exerted on the portions by the base garment worn on the supporting mannequin acts also on the sensor rod so that it can be sensed by the sensor.

Usually, considering the use condition, the bearing rod or blade is arranged substantially vertically, while the sensor rods are arranged substantially horizontally. Useful and preferred sensors are load cells; Force Sensitive Resistors (fsr) might also be used.

According to a possible aspect, the system comprises a programmable logic control system (plc control system) configured to receive information from the pressure sensors and to activate the heating of the portions of the supporting element as a function of the data sensed by the sensor. In particular the PLC is programmed to possibly apply different heat treatments to different portions of the supporting element (and thus to the garment fitted onto the supporting element itself). A different heat treatment typically implies a different heating time.

In a preferred embodiment there are provided by the software running in the PLC five different page on the PLC control system screen. Namely pages are provided for the step of calibrating load cells and for the step of correlating the load cells with compression testing devices provided with sensors so as to read numbers on screen as mmHg.

In another page body measurements are entered and processed by an algorithm that creates target compression values according to existing values.

A further step is visualized in a controlling page for the heating step, i.e. the "fixation" step; here it is calculated required amount of fixing-time for each part. As above mentioned, all the different axial locations of the garment might need to be fixed, i.e. heat treated, in different amounts according to the user profile.

So for example while one part is heated for 660 seconds another part might start from 210 seconds. When the system is started initially only the portion to be heated for 660 seconds is activated and a count down starts till a time of 210 seconds from the end of the heating step is reached. At this point heating of the other part starts. In such a way, heating of all portions ends at the same time and the cooling step is started for all portions at the same time.

A last page is created by testing each fabric several times, so as to create a chart for all the heatable portions of the mannequin that shows at each time how much the decrease of compression is obtained. That chart works synchronized with a controlling page while calculating necessary time of treatment.

A further aspect of the invention relates to a garment as obtainable with the method according to one or more of the above discussed aspects.

According to a more general aspect, the teaching of the present invention can be applied to modify the elastic properties of a garment. Exemplary parameters to estimate the modified elastic properties of a garment are stretch, growth and recovery parameters according to ASTM D3107.

More in detail, an aspect of the present invention relates to a method for modifying the elastic properties of a garment comprising the steps of: a) Producing a base garment with a fabric comprising elastic fibers, and having elasticity of at least 15%; b) Wearing said base garment on a supporting element, the supporting element having a plurality of axial supporting element portions, the supporting element being provided with a plurality of heaters operable independently one from the other to independently heat the supporting element portions, wherein the garment is produced so that, non null compressions are applied to said supporting element (1) at the supporting element portions; c) Operating the heaters to heat the base garment at said supporting element portions, so that the non null compressions exerted by the base garment are lowered; d) Cooling the base garment.

As per above, sensors of the supporting element can measure said non-null compressions.

In addition to that, it is possible that the active time of the different heaters is different between different heaters, to differently treat the garment at different axial supporting element locations.

A further aspect of the invention relates to a garment as obtainable according to one or more of the above discussed aspects, wherein different axial size location of the garment has different elastic properties, preferably at least one selected from stretch, growth, recovery measured according to ASTM D3107 at least in the weft direction. Preferably, the difference is greater than 5%. In a preferred embodiment, at least the stretch parameter is different.

In addition to stretch, growth and recovery, further differences between the fabric of portions of the garment placed at different axial locations that have been differently heat treated may be e.g. the tensile strength at least in the weft direction and the crystallinity percentage.

As an example, the tensile strength at least in the weft of the fabric samples taken from the garment of the invention at different axial locations is usually different. Known method for testing tensile strength of fabrics are known, e.g. ASTM D5034. The different portions of the garment's fabric located at different axial locations and heat treated in a different manner usually have different tensile strength when tested with the same method, under the same test parameters.

In addition to that, if the garment comprises cotton/elastane yarns such as corespun yarns, a difference in the crystallinity of different portions of the garment's fabric placed at different axial locations, that have been different heat treated, can be measured. The heat setting process on the cotton/elastane is believed to lead to a restructuring or recrystallization of the cellulose portions of the garment fabric (i.e. of the fibers of the garment). The crystallinity behaviour of the fabric can be determined in a way known in the art, e.g by using X-ray diffractometer such as a Shimadzu XRD-6000.

Structural changes induced by the heat setting process may also be identified by means of ATR-FT/IR spectroscopy of a fabric containing yarns of mixed cotton and elastomeric (e.g. elastane) fibers.

In general, the process according to the invention provides that portions of the same fabric of a garment that are placed at different axial locations are heat treated in different conditions. As a result, the garment is provided with at least different elastic properties at different axial locations, preferably at least one of stretch, growth, recover, tensile strength and crystallinity percentage.

BRIEF DESCRIPTION OF THE DRAWINGS

Further aspects and advantages in accordance with the present disclosure will be discussed more in detail with reference to the enclosed drawings, given by way of non-limiting example, wherein.

Figure 1:
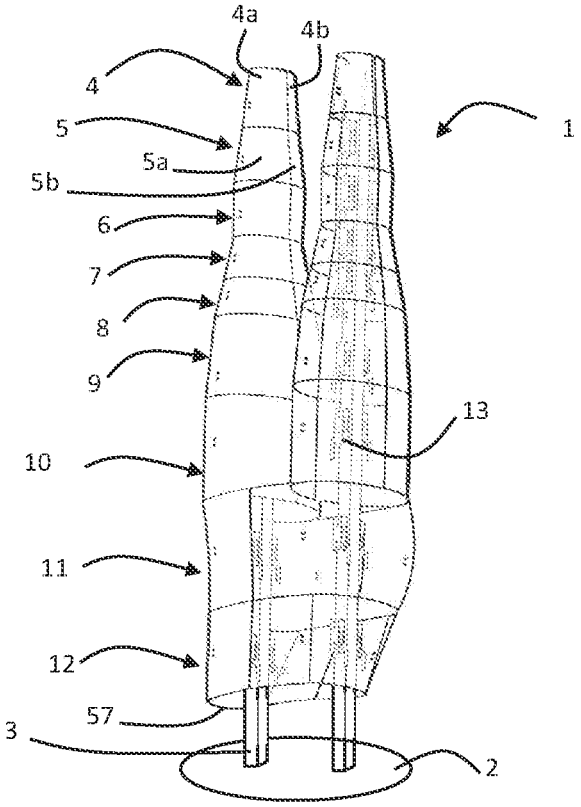
FIG. 1 shows a perspective view of a supporting element of a system according to a possible embodiment of the present invention.

The system 100 comprises a supporting element 1 comprising a plurality of supporting element portions 4, 5, 6, . . . , M at different axial supporting element locations A1, A2, . . . AN. In particular, the axial size locations B1, B2, B3, B4, B5, B6, B7, B8, B9 of the garment and the axial supporting element locations A1, A2, A3, A4, A5, A6, A7, A8, A9 of the supporting element 1 are configured in order to match one with the other, i.e. the distance between the different axial size location is the same distance between the different axial supporting element locations.

In the embodiment shown in the figures, there are nine axial supporting element locations A1-A9, and nine supporting element portions 4-12. However, the number of supporting element portions and locations may be different in different embodiments. The following description applies to all of these embodiments, independently from the number of portions and locations.

The different axial supporting element location A1-A9 are defined as location along the central axis C of the supporting element, i.e. the supporting mannequin, 1, where the central axis C is the axis of the main dimension of extension D1 (i.e. the greater one) of the supporting mannequin 1.

Preferably, the different axial supporting element locations A1-A9 are positioned at the mid-point of a height H1 of each supporting element portions 4, 5, 6, 7, 8, 9, 10, 11, 12. The height H1 is defined as a dimension parallel to the central axis C, measured between an upper end 58 of a supporting element portion 4-12 and the lower end 46 of the same supporting element portion 4-12 as e.g. shown in FIG. 3, wherein "upper" and "lower" refers to the condition of the supporting element during use.

Figure 2:
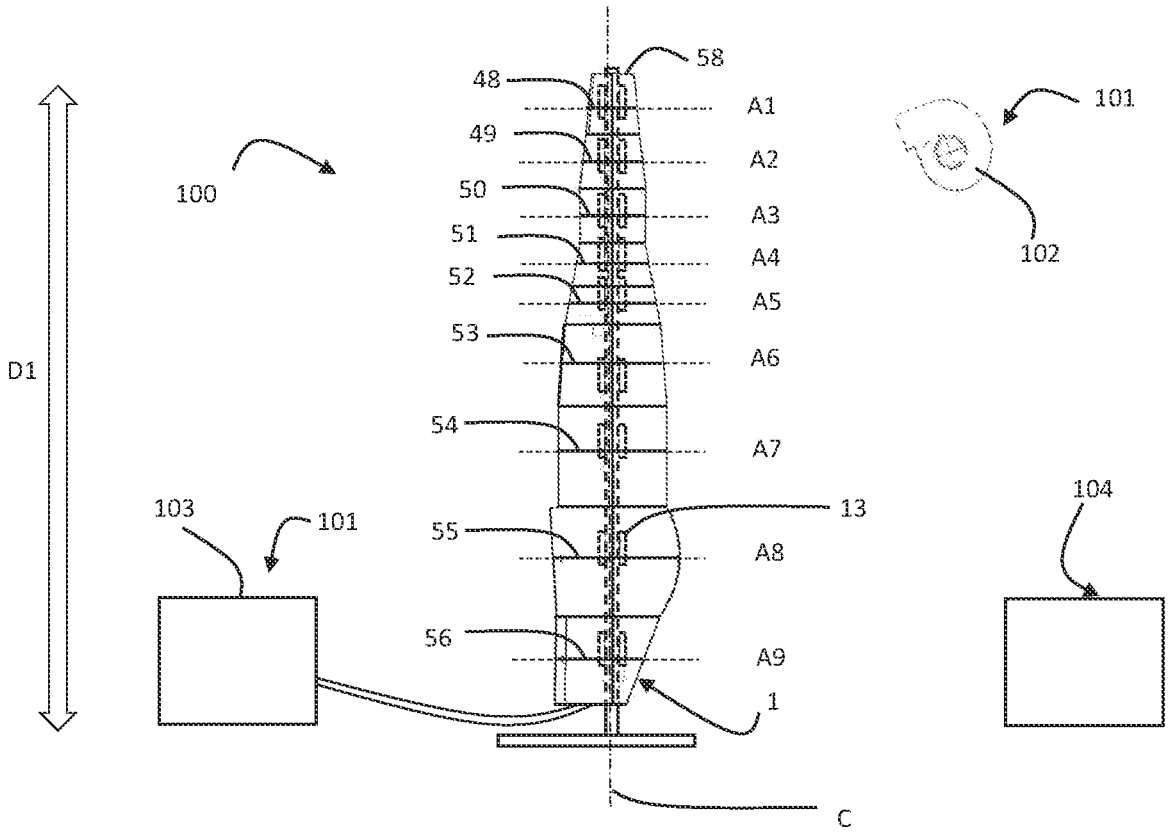
FIG. 2 shows a lateral view of the supporting element of FIG. 1.

The supporting element portions 4-12 may have different shapes in different embodiment; in preferred solutions, however, the supporting mannequin portions 4-12 have a substantially circumferential cross section, on a plane perpendicular to the central axis C that may reflect at least in part the corresponding section of a user profile, as visible in FIGS. 1 and 2. The perimeter of such a circumference may be constant along the axis C (i.e. the supporting element portions 4, 5, 6, 7, 8, 9, 10, 11, 12 may be substantially cylindrical), or may vary (e.g. the supporting element portions may be of a truncated cone shape, or a mix thereof).

Figure 5:
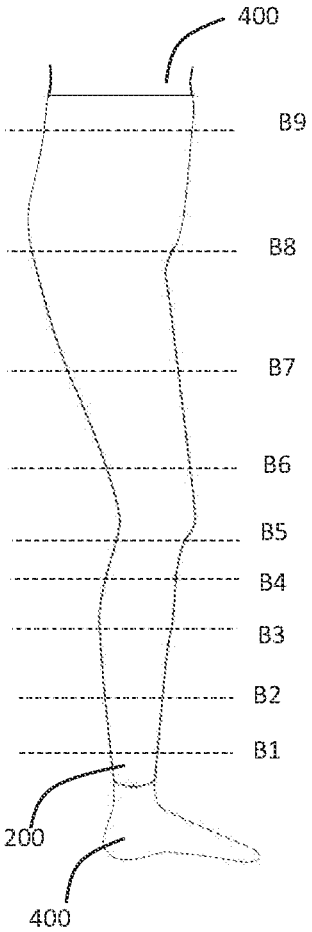
FIG. 5 shows a compression garment worn on a user body according to a possible embodiment of the present invention.

In general, the supporting element portions 4 to 12 have a plurality of circumferential length 48, 49, 50, 51, 52, 53, 54, 55, 56 at the different axial supporting element locations A1, A2, A3, A4, A5, A6, A7, A8, A9 as e.g. shown in FIG. 2 and FIG. 5. With circumferential length is meant the perimeter of the section of the supporting element portions 4 to 12 on a plane perpendicular to the axis C laying at the different axial supporting element locations A1 to A9. For easiness, due to the supporting element having preferably a circumferential section, this perimeter is called "circumferential length". In any case, such a definition applies also to non-circumferential (e.g. elliptical) shapes.

The supporting element portions 4-12 are thus arranged in series one with respect to the other along the central axis C. However, according to a preferred aspect, the supporting element portions 4-12 are separate one from another such that there is a distance D2 between two subsequent supporting element portions 4-12, measured along the axis C. In other words, the distance D2 forms a gap between two subsequent supporting element portions 4-12.

As a result, considering the use condition of the supporting element 1, there is a distance D2 between the lower-end 46 of a supporting element portion 4-12 and the upper-end 59 of the subsequently below supporting element portion 4-12 as e.g. shown schematically in FIG. 3. Such a distance D2 is preferably between XX mm and YY mm.

The supporting element portions 4-12 may be in one piece, or may be composed of a plurality of parts, joined one to the other. Preferred solutions provides for supporting element portions 4-12 made of two halves, i.e. two semi-portions 4*a*, 4*b*, 5*a*, 5*b*, etcetera, as e.g. shown in FIG. 1 and FIG. 3.

Preferably, the supporting element 1 comprises at least a central rod 3, usually arranged at the central axis C of the supporting element 1. One or more mounting rods 14 usually branch from the central rod 3 (typically perpendicularly with respect to the central rod 3) and are connected to the supporting element portions 4-12. In particular, there is usually at least one mounting rod 14 for each of the supporting element portions 4-12. If the supporting element portions are composed of a plurality of parts, there is usually a mounting rod 14 for each of these parts.

As an example, in preferred embodiments, as the one shown in the figures, each supporting element portion 4-12 is provided with two halves or semi-portions 4*a*, 4*b*, 5*a*, 5*b*. In these embodiments, the supporting element 1 is thus preferably provided with two mounting rods 14 for each of its supporting element portions 4, 5, 6, 7, 8, 9, 10, 11, 12, i.e. one mounting rod 14 for each of the semi-portions 4*a*, 4*b*, 5*a*, 5*b*.

The central rod 3 and the mounting rods 14 can be made of different materials in different embodiment, provided that enough stiffness is provided to the supporting element 1, e.g. they can be made of wood, plastic, metal, etc.

The central rod 3 is usually mounted on a base support 2, usually in the shape of a plate, in order to avoid instability or potential tilting of the supporting element 1 when resting on a flat surface.

At least part, preferably all of the supporting element portions 4-12 are multi-layer elements.

The outer layer 60 (i.e. the one more distant from the central axis C and the one that in use is in contact with a garment), as better discussed below, is usually made of (or at least comprises) a heat conductive material, such as copper. The outer layer 60 may be made of a substantially two-dimensional element, partially folded in the shape of the relevant supporting element portion 4-12.

The system 100 further comprises a plurality of heaters (41*a*, 41*b*), that are operable independently one from the other to independently heat each of the supporting mannequin portions 4, 5, 6, 7, 8, 9, 10, 11, 12.

Preferred solutions provide for electrical heaters. Usually, these heaters (41*a*, 41*b*) comprise an electric source and a resistance, typically exploiting the Joule effect. The system 100 may be provided with an internal electric source (e.g. a battery) or, more frequently, be provided with a connection element 41*a* (e.g. a plug) configured to be connected to an external electric source.

The system 100 may also be provided with suitable electric means (e.g. AC-DC transformer, etc.) to adapt the electric power of the external source to the one needed by the resistance.

The heaters (41*a*, 41*b*) usually comprise a heating element 41*b*, that is typically the resistive element of an electric heater, that is placed into contact with the outer layer 60 of the relevant supporting mannequin portion 4, 5, 6, 7, 8, 9, 10, 11, 12. The heating element 41*b* may be embodied differently in different embodiments. As an example, the heating element 41*b* may comprise one or more resistive electric cables, wound against the outer layer.

Figure 3:
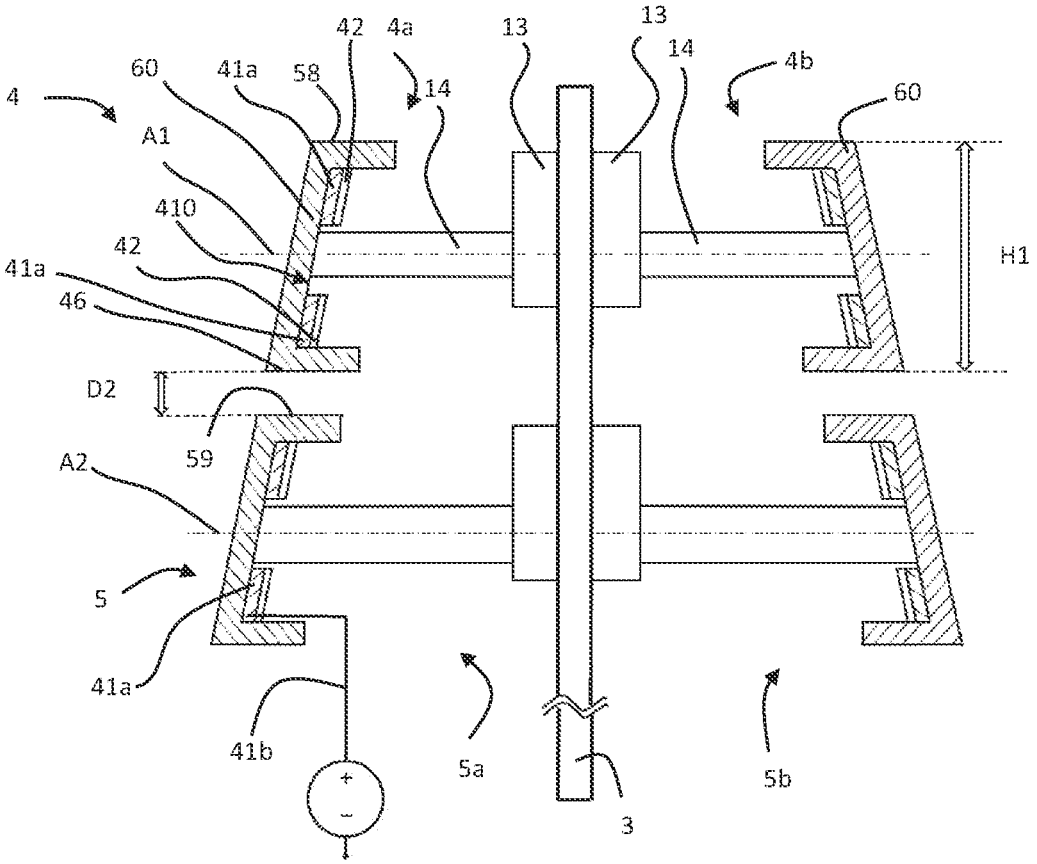
FIG. 3 shows a schematic section view of two supporting element portions of the supporting element of FIG. 1.
Figure 4:
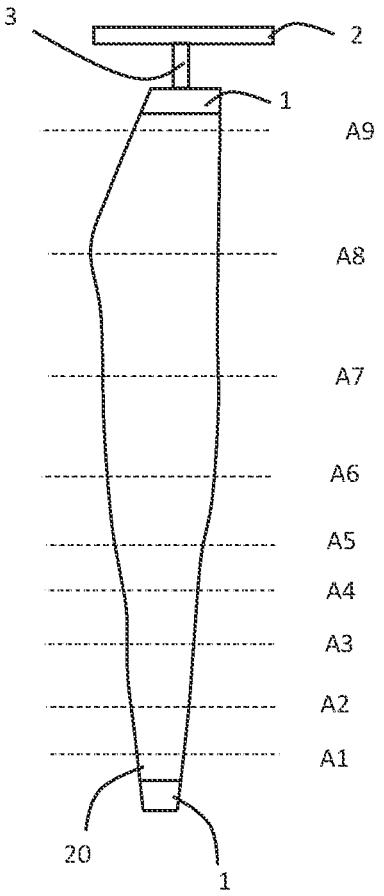
FIG. 4 shows an upside down lateral view the supporting element of FIG. 1 and a base garment worn on the supporting element according to a possible embodiment of the present invention.

In preferred embodiments, like the one shown in FIG. 3, the heating element 41*b* is shaped as a resistive plate, placed internally with respect to, and into contact with, the outer layer 60. The heating element 41*b* may be electrically insulated so that, when put into contact with the outer layer 60, e.g. a copper layer, the latter is heated without electric power being transmitted to the outer layer 60.

The heating element 41*b* is preferably configured to avoid contact with the mounting rod 14. As an example, a heating element shaped as a resistive plate can be provided with one or more holes 410, through which the mounting rod 14 can pass, without touching the heating element 41*b* itself, in order to avoid direct heating on the mounting rod 14.

The supporting mannequin portions 4, 5, 6, 7, 8, 9, 10, 11, 12 may also comprise insulation layers 42, comprising (or made of) a thermally insulating material, e.g. a ceramic material such as ceramic fibers, in order to allow heat to flow from the heating element towards the outer layer 60, but preventing (or at least limiting) flow of heat from the heating element 41*b* towards the central axis C of the supporting mannequin 1. As per the heating element 41*b*, the supporting element 1 is preferably configured to avoid contact with the mounting rods 14. As an example, the insulation layers 42 may be provided with holes 410 through which the mounting rods 14 can pass.

As a result, the mounting rods 14 are thus preferably connected to the outer layer 60 of the supporting element portions 4, 5, 6, 7, 8, 9, 10, 11, 12, while the heating element 41*b* is mounted onto the outer layer 60 (the insulating layer 42, if present, being mounted onto the heating element 41*b* and/or onto the outer layer 60).

The system 100 further comprise sensors 13 configured to measure a compression at the different supporting mannequin portions 4, 5, 6, 7, 8, 9, 10, 11, 12 applied by the base garment 20 worn on the supporting mannequin 1. Preferably, the sensors 13 are placed at the axial supporting mannequin location A1, A2, A3, A4, A5, A6, A7, A8, A9 themselves of the supporting mannequin 1. The sensors 13 are typically configured to measure a force, that can be converted into a compression via division of the force value by the area on which the sensed force is applied (e.g. the area of the outer surface of the relevant supporting mannequin portion, or half of the supporting mannequin portion, etc.). These kinds of sensors are known in the art. Preferred sensors 13 are load cells.

Preferably, the sensors 13 are coupled to the mounting rods 14, so that the sensors 13 can measure the force applied to the mounting rods 14. As discussed, this value can be converted into the compression exerted on the supporting mannequin portions at the different axial supporting mannequin locations A1, A2, A3, A4, A5, A6, A7, A8, A9.

As mentioned, supporting mannequin portions 4, 5, 6, 7, 8, 9, 10, 11, 12 of preferred embodiments are provided with two semi-portions 4*a*, 4*b*, 5*a*, 5*b* each. Each semi-portion can be provided with a mounting rod 14 and thus, in turn, with a sensor 13. As a result, there can be two sensors at each axial supporting mannequin location A1-A9. The two values read by the sensor can be treated (e.g. they can be averaged) to achieve a better precision.

The system 100 further comprises a cooling system 101 configured to cool a garment worn on the supporting mannequin 1. The cooling system 101 may be arranged externally with respect to supporting mannequin, or at least part of the cooling system may be comprised in the supporting mannequin 1. An external cooling system 101 can e.g. be embodied as a plurality of gas blowers 102, configured to direct one or more flows of gas, preferably air, against the supporting mannequin 1 (and the garment possibly worn thereon). A cooling system 101 at least partially arranged within the supporting mannequin 1 may e.g. comprise a circuit for the circulation of a coolant 103 in the supporting mannequin 1. A further example of an internal cooling system may comprise Peltier devices.

An external and (at least partially) internal cooling system may be alternative solutions for different embodiment, but they can also be combined in the same embodiment, e.g. gas blowers 102 and the circuit for a coolant 103 (and/or a peltier devices) may be used in the same embodiment.

The above discussed examples (i.e. circulation of a coolant in the supporting mannequin, blowing of a gas, preferably air, against the base garment and use of peltier devices) are the preferred solutions for the cooling system 101.

Other cooling system may as well be used, provided that they are capable of providing an effective cooling of the garment worn on the supporting mannequin 1. In particular, as better discussed below, a quick cooling is preferred for the method of the present invention.

The system 100 usually comprise a control unit 104, e.g. a programmable logic control system (plc system) configured to control the operation of the supporting mannequin 1. Usually, the control unit is configured to control the heaters (41*a*, 41*b*) so that to independently heat the separate supporting mannequin portions 4, 5, 6, 7, 8, 9, 10, 11, 12. The control unit 104 can read the data sensed by the sensor 13. The control unit 104 may control the cooling system 101.

As better discussed below, according to the method invention, a base garment 20 is treated onto the supporting mannequin 1. The base garment 20 comprises a fabric with uniform elastic properties in at least one direction, said base garment 20 comprising elastic fibers in elastic, i.e. stretch, yarns and has an elasticity of at least 15%, in at least one direction. The fabric is a woven fabric comprising elastomeric weft yarns. The fabric is more preferably a monolayer woven fabric. Elasticity can be measured with relevant ASTM standards, e.g. ASTM D3107 with respect to stretch, growth and recovery parameters. Standard parameters of the ASTM are used, e.g. 4.0 lb and 30 minutes time for ASTM D3107.

Elasticity, i.e. stretch, of at least 15% is preferably at least in the weft direction. Preferred elastic fibers for the base garment 20 are known in the art and comprise elastomeric fibers and elastomeric yarns e.g. including elastane. Suitable elastic yarns are disclosed e.g. in application WO2012/062480.

The base garment 20 includes one or more substantially circumferential portions (e.g. legs for trousers, arms and/or body for shirts) that, when worn by a user 400, surrounds the user body and apply compressive forces to the body itself. Said compressive forces to the body provide a compression generated by elastomeric yarns provided in the weft direction. In particular, as better discussed below, the method provides for providing the circumferential length (i.e. the perimeter) of the user profile 400, to which the garment treated with the method of the present invention is destined at selected locations of the user profile.

In fact, as above discussed, mannequin 1 is reproducing a user body profile that includes a body portion from waist to legs to ankles, i.e. a typical body portion for trousers. Considering an axis of these portions, extending along the main (greater) dimension of the portions (e.g. the axis of a leg of a user), it is possible to know the perimeter of these portions at different axial size locations B1, B2, B3, B4, B5, B6, B7, B8, B9 located along the axis of the portions of the user body as e.g. shown in FIG. 5. The circumferential length of a user profile 400 at the different axial size locations B1, B2, B3, B4, B5, B6, B7, B8, B9 may be acquired preferably through commercially available size charts. In this case, common reference table or charts can be used, in order to determine the circumferential length of a standard "S" user, of a standard "M" user, of a standard "L", "XL", "XXL", etc. user.

In particular, the axial size locations B1, B2, B3, B4, B5, B6, B7, B8, B9 and the axial supporting mannequin locations A1, A2, A3, A4, A5, A6, A7, A8, A9 are configured in order to match one with the other, i.e. the distance between the different axial size location is the same distance between the different axial supporting mannequin locations.

As a result, in order to carry out the present method, the circumferential length of the final user profile 400 (being of a real user or a standard reference user) are determined.

Subsequently, the desired fit for the garment on the user is determined. This is done via determining the desired compressions that the final compression garment 200 should apply onto the user at the different axial size locations B1, B2, B3, B4, B5, B6, B7, B8, B9, i.e. a value of compression for each of the axial size location of the user. This can be done via reference tables, or via the knowledge of the maker of the garment according to the requirements of the garment's final use; e.g. compression values required in a sport garment may be different from those in a pair of leggings, at the same axial locations.

In other words, given N axial size locations B1, B2, B3 . . . BN on the user profile 400, the values of N desired compression $UC_1$, $UC_2$, $UC_3$ . . . $UC_N$ that the final compression garment 200 should apply to the final user are determined.

A base garment 20 as above discussed is thus produced. The base garment 20 has yet to be treated with the present method and thus, if worn on the final user, does not yet apply the desired compressions $UC_1$, $UC_2$, $UC_3$ . . . $UC_N$ onto the final user. Also, according to an advantageous aspect of the invention, the same kind of base garment 20 can be produced for different kinds of final users. By differently treating these base garments with the present method, two identical base garment can be modified into two different final compression garments 200, each of them correctly fitting two differently sized users.

In general, a base garment 20 is worn onto the supporting mannequin, i.e. supporting mannequin, 1 to be treated. The base garment 20 and/or the supporting mannequin 1 are configured so that the base garment 20 applies a non null compression onto the mannequin 1—i.e. at the axial locations the circumferential length of the base garment in a relaxed state is smaller than the circumferential length of supporting mannequin 1, so that it is stretched by the supporting mannequin when worn onto it.

Subsequently, the actual compression $AC_1$, $AC_2$, $AC_3$ . . . $AC_N$ exerted by the base garment onto the supporting mannequin at the axial supporting mannequin locations (that, as discussed, match the axial size locations) are determined. This determination can be indirect, e.g. by knowing the measures of the supporting mannequin 1, and the measures and elastic properties of the base garment 20. However, preferred solutions provide for sensors 13 applied onto the supporting mannequin to read the actual compressions $AC_1$, $AC_2$, $AC_3$ . . . $AC_N$ exerted by the base garment 20 onto the supporting mannequin 1.

Subsequently, target compressions $TC_1$, $TC_2$, $TC_3$ . . . $TC_N$ are determined. The target compressions are the compressions that the base garment 20 should apply to the supporting mannequin 1 at the axial supporting mannequin location A1, A2, A3 . . . AN so that, when worn by the user, the garment would apply the desired compressions $UC_1$, $UC_2$, $UC_3$ . . . $UC_N$.

In a possible condition, the supporting mannequin 1 is sized exactly as the final user. In this case, the target compressions $TC_1$, $TC_2$, $TC_3$ . . . $TC_N$ coincide with the desired compression $UC_1$, $UC_2$, $UC_3$ . . . $UC_N$.

Generally, the size of the supporting mannequin 1 is different from the size of the final user (i.e. the circumferential lengths of the supporting mannequin 1 at the axial supporting mannequin do not match the circumferential length of the user at the corresponding axial size locations).

In this case, the target compression $TC_1$, $TC_2$, $TC_3$ . . . $TC_N$ that the base garment should apply to the supporting mannequin 1 are different from the desired compressions $UC_1$, $UC_2$, $UC_3$ . . . $UC_N$. The difference between the target compressions and the desired compressions is thus a function of the differences between the circumferential lengths of the supporting mannequin 1 with respect to the circumferential lengths of the user.

According to one aspect, the target compressions $TC_1$, $TC_2$, $TC_3$ . . . $TC_N$ can be evaluated as a function of the elastic properties of the base garment.

A different, and simpler, approach to evaluate the value of the target compressions $TC_i$ at an axial supporting mannequin location Ai, is to determine the target compression as a function of the ratio between the circumferential length of the supporting mannequin at the axial supporting mannequin location Ai and the user at the corresponding axial size location Bi.

In more detail, the supporting mannequin 1 is provided with a circumferential length CLS at each of the different axial supporting mannequin locations A1, A2, A3, . . . AN and, accordingly, the final user body is characterized by a circumferential length CLU at each of the different axial size locations B1, B2, B3, . . . B7.

Given the desired compressions $UC_i$ at an axial size locations Bi, the ratio between the desired compressions $UC_i$ and the target compression $TC_i$ that should be exerted by the base garment on the supporting mannequin at the relevant axial supporting mannequin location Ai is substantially identical to the ratio between the circumferential length CLUi of the final user at the axial size location Bi and the circumferential length CLSi of the supporting mannequin at the relevant axial supporting mannequin location Ai. As a result, the target compression at an axial supporting mannequin location Ai can be evaluated according to formula TCi=UCi*CLSi/CLUi.

As evident from the above discussion, in the above formula, the symbols are as follows.

TCi is the target compression that the base garment should apply on the supporting mannequin at the i-th axial supporting mannequin location Ai, in order for the final compression garment to exert the desired compression UCi on the final user body at the corresponding axial size locations Bi.

CLSi is the circumferential length of the supporting mannequin at axial supporting mannequin location Ai.

UCi is the desired compression that the final compression garment should exert on the final user body at axial size location Bi.

CLUi is the circumferential length of the final user body at axial size location Bi (in cm).

Once the target compressions $TC_1$, $TC_2$, $TC_3$ . . . $TC_N$ are determined, the base garment is treated until the actual compressions $AC_1$, $AC_2$, $AC_3$ . . . $AC_N$ become the target compressions.

In particular, the supporting mannequin 1 (and thus the base garment 20 worn on the supporting mannequin) is heated. In more detail, each of the supporting mannequin portions is heated as a function of the difference between the actual compressions $AC_1$, $AC_2$, $AC_3$ . . . $AC_N$ and the target compressions $TC_1$, $TC_2$, $TC_3$ . . . $TC_N$. Since this difference may be different at different axial supporting mannequin locations, different heat treatments can be applied at different axial supporting mannequin locations. Different heat treatments mean that the heat treatment can be applied for a different time and/or with a different temperature between different axial supporting mannequin locations A1, A2, A3, A4, A5, A6, A7, A8, A9.

It is also possible that at some axial supporting mannequin locations, the actual compression is already equal to the target compression. In that case, the base garment 20 is not heat treated at those axial supporting mannequin locations (i.e. the relevant supporting mannequin portions 4, 5, 6, 7, 8, 9, 10, 11, 12 are not heated).

Preferably, where the heat treatment is applied, the temperature of the heat treatment is substantially the same, while only the time is changed between different axial supporting mannequin locations A1, A2, A3, A4, A5, A6, A7, A8, A9. In particular, the active heaters (41*a*, 41*b*) (usually the heating element 41*b*) reaches a temperature above 100° C., where with "active heaters" is meant the heaters (41*a*, 41*b*) actually heating the base garment 20, thus excluding the possibly non-operating ones—i.e. the ones coupled the axial supporting mannequin locations where the actual compression already matches the target compression.

Applying heat to the base garment usually provides for a reduction of the value of the compression applied by the base garment 20 to the supporting mannequin 1. The longer the treatment and/or the higher the temperature, the higher will be the lowering of the compression applied by the base garment 20. As a result, the target compression usually is lower than the actual compression (or at most equal to the actual compression when no heat treatment is needed). In view of that, it is preferred that the base garment is dimensioned to initially apply a higher compression with respect to all of the possible final sizes of the possible user of the final compression garment 200, or to apply the desired compression to the smallest possible size of a user for the final compression garment 200.

Subsequently, cooling of the base garment is operated, in order to fix the properties of the garment obtained with the heat treatment. As with the heating, the cooling system is configured to independently cool the garment at the different axial supporting mannequin locations.

However, this may be a difficult operation to achieve. In addition to that, it is possible to cool a portion of the base garment that was not heat treated (as the actual compression already matched the target compression) without particular side effects. As a result, it is preferable that cooling is applied to the whole base garment, at the same time.

Since the properties of the base garment are known, it is possible to calculate the time needed for each heat treatment to transform the actual compression into the target compression. As a result, the heat treatments of the base garment at different axial size locations (i.e. the heat treatment of the corresponding different mannequin portions) can be started at different times, so that all the heat treatments are ended substantially at the same time, thus allowing cooling of the whole base garment.

As above discussed, the cooling is preferably "quick", so that the supporting mannequin is brought back to substantially room temperature in less than 30 seconds.

A further aspect of the present invention relates to a method for modifying the elastic properties of a garment comprising the steps of a) producing a base garment 20 with a fabric comprising elastic fibres and having elasticity of at least 15% measured according to the ASTM D3107; b) The base garment 20 is worn on a supporting mannequin 1, having a plurality of supporting mannequin portions 4, 5, 6, 7, 8, 9, 10, 11, 12, the supporting mannequin 1 is provided with a plurality of heaters 41*a*, 41*b* operable independently one from the other to independently heat the supporting mannequin portions 4, 5, 6, 7, 8, 9, 10, 11, 12. The garment is therefore produced so that non null compressions are applied to said supporting mannequin 1 at the supporting mannequin portions 4, 5, 6, 7, 8, 9, 10, 11, 12 c) the heaters 41*a*, 41*b* heat the base garment 20 at said supporting mannequin portions 4, 5, 6, 7, 8, 9, 10, 11, 12, so that the non null compressions exerted by the base garment 20 are lowered d) the garment 20 is cooled.

According to a possible aspect, the active time of the different heaters 41*a*, 41*b* is different between different heaters 41*a*, 41*b*, to differently treat the garment at said supporting mannequin portions 4, 5, 6, 7, 8, 9, 10, 11, 12.

The modified elastic properties of the final garment 200 can be detected by measuring at least one of stretch, growth and recovery parameters measured according to the ASTM D3107, of fabric samples taken at different locations of the garment.

A further aspect of the present invention relates to a garment 200 as obtainable according to one or more of the above discussed aspects, wherein different axial size locations of the garment have different elastic properties, preferably at least one selected from stretch, growth recovery measured according to ASTM D3107 at least in the weft direction.

The presence of different elastic properties of the fabric in the final garment 200 at different axial size locations, i.e. at different axial locations in the garment, is measurable by selecting a fabric sample 1 at one axial size location Bi of the heat-treated final garment 200, and a fabric sample 2 selected at another location Bj of the heat-treated final garment 200. Said axial size location Bi is different from said axial size location Bj.

If sample 1 and sample 2 have been heat treated at different temperatures and/or for different active times by the relevant heaters (41*a*, 41*b*) their elastic properties according to ASTM D3107 will be different.

Dimensions of sample 1 and sample 2 are according to the ASTM D3107. Preferably sample 1 and sample 2 are centred on the corresponding axial size location Bi and Bj. In other words, the total area of each sample is divided by each corresponding axial size locations in two equal areas.

The different elastic properties of sample 1 and sample 2 are measured according to ASTM D3107.

At least one of the fabric's properties selected from stretch, growth and recovery measured according to ASTM D3107 is different between sample 1 and sample 2, preferably at least two or all the properties among stretch, growth and recovery measured according to ASTM D3107 are different between sample 1 and sample 2.

Other properties of the samples 1 and 2 may be different from each another as a result of a different heat treatment. Tensile strength is usually different and typically increases in the fabric portions that are heat treated with an increase in temperature up to 140° C. Also, in case the sample comprise cotton/elastane corespun yarns, a difference in the crystallinity index of the two samples can be observed. Crystallinity percentage in a blend cotton/elastan fabric may increase in a heat-treated fabric portion: the crystallinity percentage of a treated fabric may be greater by twice (or more) than the value of the crystallinity percentage of an untreated fabric portion of the same garment fabric.

In the untreated base garment 20, as the fabric is structurally and chemically identical in all its parts, the fabric of the garment has the same elastic properties in at least one direction, preferably at least in weft direction; in other words, stretch, growth and recovery measured according to ASTM D3107 are the same at all locations of the garment, i.e. a fabric sample 1 at one axial size location Bi of the base garment 20, and a fabric sample 2 selected at another, different, axial size location Bj of the base garment 20 have the same elastic properties measured according to ASTM D3107.

Some exemplary embodiments are discussed here below.

Two identical base garment are differently treated on the same supporting mannequin in order to provide two final compression garments that fit in the same manner on two different kind of users.

Example 1

The exemplary data discussed in the first example is as follows.

TABLE 1

| | | | |
|---|---|---|---|
| axial size location | B1 | B2 | B3 |
| actual compression | AC1 | AC2 | AC3 |
| desired compression | UC1 | UC2 | UC3 |
| target compression 1st user | $TC_{1a}$ = AC1 | $TC_{2a}$ = 0.7*AC2 | $TC_{3a}$ = 0.8*AC3 |
| heat time 1st user | 0 s | 35 s | 20 s |
| target compression 2nd user | $TC_{1b}$ = 0.9 *AC1 | $TC_{2b}$ = 0.6*AC2 | $TC_{3b}$ = 0.6*AC3 |
| heat time 2nd user | 15 s | 40 s | 35 s |

For sake of clarity, only three axial locations are considered. The first kind of user is smaller than the second kind user. For a user of the first kind, at the three axial size locations that correspond the axial supporting mannequin locations A1, A2, A3, the final compression garment 200 should exert the desired compressions $UC_1$, $UC_2$ and $UC_3$.

A base garment 20 is prepared. When mounted onto the supporting mannequin, the base garment 20 exerts actual compressions $AC_1$, $AC_2$ and $AC_3$.

In order for the final compression garment 200 to exert the desired compressions $UC_1$, $UC_2$ and $UC_3$, it is determined that the base garment 20 should be treated until it applies on the supporting mannequin the target compressions $TC_{1a}$, $TC_{2a}$ and $TC_{3a}$. Then, since the actual compression $AC_1$ at the axial supporting mannequin location A1 is already equal to the target compression $TC_{1a}$, no heat treatment is applied to the base garment at the axial supporting mannequin location A1. In order to lower the other two actual compressions $AC_1$ and $AC_2$ until they reach the relevant target compressions $TC_{1a}$ and $TC_{2a}$, it is determined that a heating of 35 seconds is needed at the second axial supporting mannequin location A2, and a heating of 20 s is needed at the third axial supporting mannequin location A3.

Heating at the second axial supporting mannequin location A2 starts 15 seconds before the heating of the third axial supporting mannequin location A3.

At the end of the heating process, the whole base garment is cooled. When worn by the a user of the first kind, such a user will feel the desired compressions $UC_1$, $UC_2$ and $UC_3$ at his/her three axial size locations corresponding to the axial supporting mannequin locations A1, A2 and A3.

For a user of the second kind, at the three axial size locations that correspond the axial supporting mannequin locations A1, A2, A3, the final compression garment 200 should exert the same desired compressions $UC_1$, $UC_2$ and $UC_3$ as per the first kind of user.

A base garment 20 is prepared. Since the base garment 20 for the second kind of user is identical to the base garment prepared for the first kind of user, when mounted onto the same supporting mannequin, the base garment 20 exerts the same actual compressions $AC_1$, $AC_2$ and $AC_3$.

However, since the second user is bigger than the first user, in order for the final compression garment 200 to exert the desired compressions $UC_1$, $UC_2$ and $UC_3$, it is determined that the base garment 20 should be treated until it applies on the supporting mannequin the target compressions $TC_{1b}$, $TC_{2b}$ and $TC_{3b}$, that are lower than the target compression $TC_{1a}$, $TC_{2a}$ and $TC_{3a}$ for the first kind of user.

In order to lower the actual compressions $AC_1$, $AC_2$ and $AC_3$ until they reach the relevant target compressions $TC_{1b}$, $TC_{2b}$ and $TC_{3b}$, it is determined that a heating of 10, 40 and 35 seconds are needed respectively at the three axial supporting mannequin locations A1, A2 and A3.

Heating at the second axial supporting mannequin location A2 starts 25 seconds before the heating of the first axial supporting mannequin location A1 and 5 seconds before heating of the third axial supporting mannequin location A3.

At the end of the heating process, the whole base garment is cooled. When worn by the second user, such a user will feel the desired compressions $UC_1$, $UC_2$ and $UC_3$ at his/her three axial size locations corresponding to the axial supporting mannequin locations A1, A2 and A3, i.e. the same compression felt by a user of the first kind when wearing a final compression garment 200 destined to such a first user.

Similarly, two identical base garment 20 may be differently treated to provide two different final compression garment 200 having different fits for the same kind of users.

Example 2

The following further example shows an exemplary embodiment relating how to evaluate the target compressions $TC_1$, $TC_2$, $TC_3$ . . . $TC_N$ as a function of the desired compressions $UC_2$, $UC_3$, . . . , $UC_N$, and of measures of the supporting mannequin and of the final user.

In particular, in the following example, seven different axial supporting mannequin location A1-A7 and thus seven different corresponding axial size location (locations of the garment) B1-B7 are considered.

The first column defines the different axial supporting mannequin locations A-A7. In the second column, the circumferential length CLS1-CLS7 of the supporting mannequin for each of the axial supporting mannequin locations A1-A7 is shown. In the third column, the desired compression $UC_2$-$UC_7$, which is the compression that the final compression garment should exert on the final user body at the axial size location B1-B7 is shown.

The target compressions $TC_1$-$TC_7$ to be applied on the supporting mannequin 1 in order to have the desired compressions $UC_1$-$UC_7$ on the user are shown on the last column. In particular, as per the simplified approach previously discussed, the values of the target compressions are evaluated according to the formula TCi=UCi*CLSi/CLUi. As an example, considering axial supporting mannequin location A1, the above formula equals to: $TC_1=UC_1*CLS_1/CLU_1$=15 mmHg*28.2 cm/23 cm=18.4 mmHg.

The above formula is applied to all of the axial supporting mannequin locations A1-A7, to obtain the following data:

TABLE 2

| Axial supporting mannequin location | Circumferential length (CLS-i) – Supporting mannequin (cm) | Circumferential length (CLU-i) – User (cm) | Desired compression – User (UC-i) (mmHg) | Target compression – Supporting mannequin (TC-i) (mmHg) |
|---|---|---|---|---|
| A1 (ankle) | 28.2 | 23 | 15 | 18.4 |
| A2 | 32.8 | 29 | 12.8 | 14.5 |
| A3 (calf) | 37.5 | 36 | 9.8 | 10.2 |
| A4 | 41 | 35 | 9 | 10.5 |
| A5 | 44 | 40 | 8.3 | 9.1 |
| A6 | 51 | 50 | 7.5 | 7.7 |
| A7 (tight) | 56.5 | 58 | 6 | 5.8 |

As above mentioned, the process of the invention changes the elastic properties of the fabric that has been treated; namely the stretch value of a treated fabric may be 38%, preferably 4% to 50%, preferably 10% to 50% less than the stretch value in the same non-treated fabric.

As discussed, after the process of the invention is carried out on a garment, the properties (measured according to ASTM D3107) of the fabric of a garment are different in different locations B1-B9 of the said garment where the heat treatment was carried out in a different manner, e.g. by heating for different times and/or at different temperatures. As an example the difference in the value of stretch of a sample of fabric at e.g. location B1 will be different from (e.g. lower than) the stretch value of a sample of fabric at location B9. In embodiments, said difference expressed in percent of the ratio of the difference between greater (SB9) and smaller (SB1) value divided by the greater value, i.e. (SB9–SB1/SB9)*100, is in the range of 4% to 50%, preferably 10% to 40%.

More generally, in a garment treated according to the process of the present invention, there will be at least two portions of fabric at different locations having different properties that provide a ratio as above disclosed. In the same garment two portions of fabric that have not been treated will have the same or substantially the same stretch values and the ratio will be 0% or an equivalent low value.

As an example for two samples taken from two parts X and Y of the garment, e.g. a pair of pants, the ratio of the stretch values (SX–SY/SX)*100 is in the range of 0% to 50%, depending on whether they were treated or not. In case the two samples were not treated (or were treated in identical manner) the said ratio (SX–SY/SX)*100 is 0% or about 0%. In case the two samples were treated for different times and/or at different temperatures so that sample X has greater stretch than sample Y, the ratio (SX–SY/SX)*100 is in the range of 4% to 50%, preferably 10% to 40%. In embodiments, all the couples of samples of a garment may give ratio values within the said range.

The invention claimed is:

1. A method for producing a compression garment for a user, the compression garment having a plurality of size circumferential lengths at different axial garment locations to apply compression to corresponding locations of the user when said compression garment is worn, the method comprising the steps of:

A. providing a plurality of desired compressions to be applied by the compression garment on the user at said plurality of different axial garment locations;

B. producing a base garment with a woven fabric comprising elastic fibers, said fabric having a stretch of at least 15% when measured according to ASTM D3107;

C. disposing said base garment on a supporting mannequin, the supporting mannequin including a plurality of heaters located at different axial heater locations of said supporting mannequin and independently operable;

D. determining actual compressions exerted by the base garment on the supporting mannequin at different axial mannequin locations of said supporting mannequin corresponding to said different axial garment locations;

E. determining target compressions to be exerted by said base garment at said different axial garment locations on the supporting mannequin at said different axial mannequin locations, so that the compression garment exerts the desired compression at the different axial garment locations when worn by said user;

F. operating at least some of said heaters to heat said base garment at said different axial garment locations, so that the actual compressions exerted by the woven fabric of the base garment comprising elastic fibers, are lowered to reach the target compressions; and G. cooling the base garment;

wherein, in said step B the base garment is produced so that, at said step C, non-null compressions are applied by the base garment to said supporting mannequin at said axial mannequin locations.

2. The method according to claim 1, wherein in said step D, said determining actual compressions comprises measuring the actual compressions via sensors located on a plurality of supporting mannequin portions at said different axial mannequin locations of said supporting mannequin.

3. The method according to claim 2, wherein said sensors further measure the actual compressions during said step F.

4. The method according to claim 1, wherein the at least some of the heaters in said step F reach a temperature in the range of 100° C. to 130° C.

5. The method according to claim 1, wherein an active time of the at least some of the heaters is calculated as a function of the difference between the actual compression and the corresponding target compression measured at the associated axial mannequin location.

6. The method according to claim 1, wherein said operating the at least some of the heaters comprises ending heating treatment of the heaters at substantially the same time.

7. The method according to claim 1, wherein said cooling is performed by circulation of a coolant in the supporting mannequin or use of at least one peltier device.

8. The method according to claim 1, wherein said cooling provides for a loss of temperature of the supporting mannequin of at least 100° C. degrees at at least one axial mannequin location, in less than 30 seconds.

9. The method according to claim 1, wherein at least part of said cooling is performed with the base garment disposed on the supporting mannequin.

10. A system for performing at least said steps C to G of the method according to claim 2, said system comprising:

the supporting mannequin with said plurality of supporting mannequin portions at said different axial mannequin locations;

the plurality of independently operable heaters, said supporting mannequin portions disposed separate from one another;

a cooling system configured to cool the base garment disposed on the supporting mannequin; and the sensors configured to measure said actual compression at said different axial mannequin locations of said plurality of said supporting mannequin portions.

11. The system of claim 10, further comprising a programmable logic control (plc) control unit configured to receive compression data from said sensors and to independently operate said heaters to heat said supporting mannequin portions for a required time as a function of said compression data.

12. A garment formed according to the method of claim 9, wherein at said different axial garment locations, the fabric has different elastic properties, said elastic properties comprising at least one of stretch, growth recovery according to ASTM D3107 at least in the weft direction, tensile strength at least in the weft direction, and crystallinity.

13. A method for modifying elastic properties of a garment comprising the steps of:

providing a base garment with a fabric comprising elastic fibers, and having stretch of at least 15%;

disposing said base garment on a supporting mannequin, the supporting mannequin having a plurality of supporting mannequin portions at a plurality of axial mannequin locations, the supporting mannequin including a plurality of heaters operable independently to independently heat said supporting mannequin portions at said axial mannequin locations wherein the base garment applies non-null compressions to said supporting mannequin portions as produced;

determining target compressions to be exerted by said base garment at different axial garment locations associated with said plurality of axial mannequin locations, so that a compression garment exerts a desired elastic compression at the different axial garment locations when worn by said user;

operating the heaters to heat the base garment at at least some of said supporting mannequin portions to lower the non-null compressions exerted by the base garment; and cooling the base garment once said target compression values are reached.

14. The method according to claim 13, further comprising sensors of the supporting mannequin measuring said non-null compressions.

15. The method according to claim 13, wherein the use different active times to treat the garment differently at the different axial supporting mannequin locations.

16. A garment obtainable from a woven fabric according to the method of claim 13, wherein samples of the garment fabric taken at different axial size locations of the garment have different elastic properties, said elastic properties including stretch and growth recovery according to ASTM D3107 at least in the weft direction.

17. The garment according to claim 12, wherein two fabric samples taken from two parts X and Y at different said axial size locations of said garment have a stretch value according to ASTM D3107 of SX and SY, respectively, and wherein the ratio of said stretch values (SX−SY/SX)*100 is in the range of 4% to 50%.

18. The garment according to claim 12, wherein two fabric samples taken from two parts X and Y at different said axial size locations of the said garment have different values for at least one of tensile strength and crystallinity.

19. The method according to claim 1, further comprising entering body measurements into a programmable logic control (plc) control unit and wherein said body measurements are processed by an algorithm that creates said target compressions.

20. The method according to claim 13, further comprising entering body measurements into a programmable logic control (plc) control unit and wherein said body measurements are processed by an algorithm that creates said target compressions.

21. A system for performing a method for producing a compression garment for a user, the compression garment having a plurality of size circumferential lengths at different axial garment locations to apply compression to corresponding locations of the user when said compression garment is worn, the method comprising the steps of:

a. producing a base garment with a woven fabric comprising elastic fibers, said fabric having a stretch of at least 15% when measured according to ASTM D3107;

b. disposing said base garment on a supporting mannequin, the supporting mannequin including a plurality of heaters located at different axial heater locations of said supporting mannequin and independently operable;

c. measuring actual compressions exerted by the base garment on the supporting mannequin via sensors located at a plurality of supporting mannequin portions at said different axial mannequin locations of said supporting mannequin corresponding to said different axial garment locations;

d. determining target compressions to be exerted by said base garment at said different axial garment locations on the supporting mannequin at said different axial mannequin locations, so that the compression garment exerts the desired compression at the different axial garment locations when worn by said user;

e. operating at least some of said heaters to heat said base garment at said different axial garment locations, so that the actual compressions exerted by the base garment are lowered to reach the target compressions; and f. cooling the base garment;

wherein, in said step a, the base garment is produced so that, at said step b, non-null compressions are applied by the base garment to said supporting mannequin at said axial mannequin locations, said system comprising:

the supporting mannequin with said plurality of supporting mannequin portions at said different axial mannequin locations;

the plurality of independently operable heaters, said supporting mannequin portions disposed separate from one another;

a cooling system configured to cool the base garment disposed on the supporting mannequin;

the sensors configured to measure said actual compression at said different axial mannequin locations of said plurality of said supporting mannequin portions; and a programmable logic control (plc) control unit configured to receive compression data from said sensors and to independently operate said heaters to heat said supporting mannequin portions for a required time as a function of said compression data.

* * * * *